US008485755B2

(12) United States Patent
Menzenbach et al.

(10) Patent No.: US 8,485,755 B2
(45) Date of Patent: Jul. 16, 2013

(54) GROUND WORKING MACHINE, AS WELL AS METHOD FOR MILLING SOILS OR TRAFFIC AREAS

(75) Inventors: Christoph Menzenbach, Neustadt/Wied (DE); Harald Kroell, St. Katharinen (DE); Cyrus Barlmani, Koenigswinter (DE); Guenter Haehn, Koenigswinter (DE)

(73) Assignee: Wirtgen GmbH (DE)

( * ) Notice: Subject to any disclaimer, the term of this patent is extended or adjusted under 35 U.S.C. 154(b) by 15 days.

(21) Appl. No.: 13/298,377

(22) Filed: Nov. 17, 2011

(65) Prior Publication Data

US 2012/0128419 A1 May 24, 2012

(30) Foreign Application Priority Data

Nov. 18, 2010 (DE) ..... 10 2010 051 551

(51) Int. Cl.
*E01C 23/088* (2006.01)

(52) U.S. Cl.
USPC ..... 404/84.05; 404/94; 299/39.2; 299/39.6

(58) Field of Classification Search
USPC .. 299/36.1, 39.1, 39.2, 39.4, 39.6; 404/84.05, 404/90, 94
See application file for complete search history.

(56) References Cited

U.S. PATENT DOCUMENTS

| | | | | |
|---|---|---|---|---|
| 5,893,677 | A | 4/1999 | Haehn et al. | |
| 6,887,013 | B2 * | 5/2005 | Ley et al. | 404/90 |
| 7,585,128 | B2 * | 9/2009 | Hall et al. | 404/75 |
| 7,918,512 | B2 | 4/2011 | Mannebach et al. | |
| 8,075,063 | B2 | 12/2011 | Mannebach et al. | |
| 8,100,480 | B2 * | 1/2012 | Kotting et al. | 299/39.2 |
| 8,177,456 | B2 * | 5/2012 | Haroldsen | 404/94 |
| 2010/0209189 | A1 | 8/2010 | Menzenbach et al. | |

FOREIGN PATENT DOCUMENTS

| | | | |
|---|---|---|---|
| EP | 2218823 | A2 | 8/2010 |
| WO | 9624725 | A1 | 8/1996 |
| WO | 2005054578 | A1 | 6/2005 |

* cited by examiner

*Primary Examiner* — Gary Hartmann
(74) *Attorney, Agent, or Firm* — Waddey & Patterson, P.C.; Lucian Wayne Beavers

(57) ABSTRACT

In a ground working machine (1) for milling soils (2) or traffic areas, it is provided that a controller (18) for terminating the milling process controls the milling depth of a milling device (8) along a specified trajectory (24) in conjunction with simultaneous forward and reverse travel (5,7), thus enabling the milling device (8) to be raised into the upper position (9) disengaged from the ground without a depression (22) resulting from raising the milling device (8) remaining in the worked ground surface (3).

18 Claims, 2 Drawing Sheets

GROUND WORKING MACHINE, AS WELL AS METHOD FOR MILLING SOILS OR TRAFFIC AREAS

Figure 1:
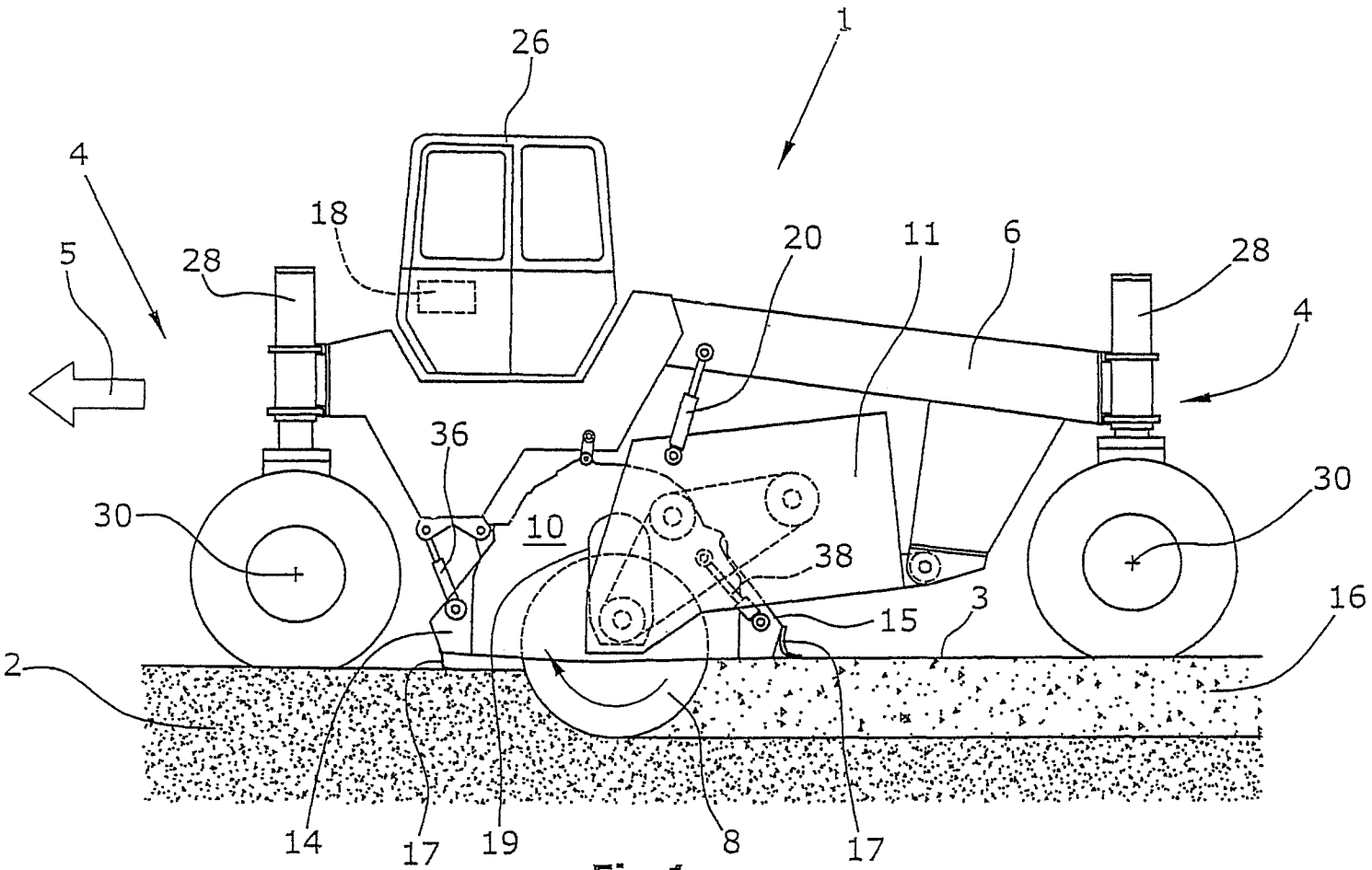

The invention relates to a ground working machine for milling soils or traffic areas, or a method, respectively, for milling soils or traffic areas using a ground working machine.

Such construction machines, also called stabilizers or recyclers, are used for the processing of materials, namely, for example, the stabilization of soils of insufficient load-bearing capacity, the pulverization of asphalt pavements and the recycling of bound or unbound carriageway surfaces. For soil improvement or stabilization, it is known to introduce a pulverized binding agent into the soil in order to increase the suitability for placing and bearing capacity of said soil. The known ground working machines comprise a milling rotor revolving in a mixing chamber, said milling rotor being arranged, in a height-adjustable fashion, below a hood enclosing the milling rotor and mounted at the machine frame. The ground working machine may be automotive in design. Examples of such machines are described in WO 96/24725, WO 2005/054578 or EP 2218823 A respectively.

Reference is made to these earlier patent applications regarding the description of the individual components of such a ground working machine.

Adapted to the specific application, the required processes, such as loosening and crushing of the milled carriageway material, addition of binding agents, mixing and spreading of added materials etc., take place in the mixing chamber located between the hood and the milling device.

Such machines are frequently equipped with an enclosed operator's platform. The operator's platform is preferably arranged at the front as seen in the direction of travel, or even on or in front of the front axle with newer machine models. Owing to the position of the operator's platform, it is not possible to monitor the milling device from the operator's platform, especially also because the hood fully encloses the milling device and rests on the ground surface.

In the milling process, the mixed aggregate is whirled around in the mixing chamber so that, when the milling rotor is stopped, a larger amount of mixed aggregate settles in front of and behind the milling rotor respectively. Now, if the milling rotor is raised in order to be disengaged from the ground, a depression remains in that place where the milling rotor has been, said depression having a depth of approximately 40% of the milling rotor diameter and extending over the entire length of the milling rotor, corresponding to the working width of the ground working machine.

If, for example, a larger area the size of a football field is worked in several cuts, such accumulations of mixed aggregate, or depressions respectively, remain at the turnaround points of each cut, which need to be levelled manually or by means of a grading device. In other words, each time the milling process needs to be interrupted because the ground working machine needs to be repositioned to the next cut or to a different working site, the problem arises that, by raising the milling rotor, the ground surface worked is left in a non-levelled condition. This is aggravated further by the fact that the machine operator cannot monitor the working site.

It is therefore the object of the present invention to specify a ground working machine for milling soils, as well as a method for milling soils, in which, upon termination of the milling process, the ground surface worked can be left in an essentially level condition.

The invention advantageously provides that a controller for terminating the milling process controls the milling depth of the milling device along a specified trajectory in conjunction with simultaneous coordinated forward or reverse travel, thus enabling the milling device to be raised into the upper position disengaged from the ground without a depression resulting from raising the milling device remaining in the ground surface worked.

In particular, the depression exposed when raising the milling device is to be filled with mixed aggregate. It is understandable in this regard that absolute evenness cannot be achieved; however, the depression is filled up with mixed aggregate so that no significant irregularities remain.

Upon termination of the milling process, the machine operator sends a signal to the controller which, in order to terminate the milling process, then controls the milling depth of the milling device along a specified trajectory in conjunction with simultaneous forward or reverse travel of the ground working machine. The trajectory may, for example, be stored in the controller and coordinates raising of the milling device during travel of the ground working machine in such a fashion that the milling device can be raised into the upper position disengaged from the ground while simultaneously filling up the depression in the ground surface worked exposed by raising the milling device. This requires a coordinated height adjustment of the milling device in conjunction with simultaneous forward or reverse travel in such a manner that the accumulations of mixed aggregate in front of and behind the milling device as seen in the direction of travel are successively conveyed into the depression exposed progressively as a result of raising the milling device. The trajectory specified by the controller when raising the milling device may be determined empirically and may, where applicable, be stored in a memory in the controller for different soil conditions. The controller according to the invention therefore results in the machine operator not having to concern himself with raising the milling device but merely informing the controller as to when the milling process is to be terminated, so that the machine operator can concentrate solely on driving and steering the ground working machine. The fact that no unwelcome depressions and elevations of the ground surface worked remain in those places where the ground working machine is required to be turned around or to change to a different working cut dispenses with reworking of the soils or ground surfaces worked. Automatic filling up of the depression with previously worked mixed aggregate additionally ensures that, upon termination of the milling process, no differences in density exist in the area of the depression compared with the soil loosened in the continuous milling process.

Operation of the ground working machine is made easier for the machine operator as he can concentrate on the operation and a possible change of position of the machine without having to simultaneously coordinate the raising movement of the milling device.

Controlling along the trajectory means that, for example, the axis of rotation of the milling device or, alternatively, the lowest point of engagement of the milling device adheres to such a trajectory during raising.

It is preferably provided that the controller controls the milling depth of the milling device along a trajectory specified in accordance with the direction of travel of the machine frame.

In terms of the direction of rotation, a distinction is made between a milling process against the direction of travel and a milling process in the direction of travel, depending upon whether the direction of rotation of the milling device and the direction of rotation of the wheels of the ground working machine move in opposite directions or in the same direction of rotation. Consequently, different trajectories may be stored in the controller in accordance with the direction of travel of the machine frame and the type of milling device.

A preferred embodiment provides that the controller synchronizes the path of the height adjustment of the milling device with the path in the direction of travel. Such a controller offers the advantage of being independent of the travel speed and results in the trajectory for the height adjustment of the milling device being adhered to at any given travel speed.

A particularly preferred embodiment provides that the controller for terminating the milling process additionally controls the position of at least one hood flap. The position of the hood flap enables the amount of mixed aggregate to be controlled which is levelled off in order to fill up the depression exposed by raising the milling device.

It is particularly preferably provided that the flap position of the trailing hood flap as seen in the direction of travel is controllable to a height which takes into consideration the increase in volume of the mixed aggregate due to loosening of the same during the milling process. Processing the soil by milling causes a loosening of the same which leads to an increase in volume of the mixed aggregate so that the trailing hood flap, which acts like a scraper blade, cannot be moved at the original height of the ground surface but preferably at a distance from the ground which needs to take into consideration the increase in volume of the mixed aggregate.

As previously explained, the controller may hold, depending on soil conditions, different trajectories to be selected by the machine operator, said trajectories also including material-based adjustment values for the position of the hood flaps, the bottom edge of which determines the scraping height above the ground.

The trajectory specified by the controller for termination of the milling process and successive reduction of the milling depth may follow a degressively increasing curve.

One embodiment provides that the trajectory specified by the controller for termination of the milling process essentially exhibits the curve of an asymptotic function, in particular an arctan function.

The ground working machine may be provided with a height-adjustable machine frame. In this arrangement, it may be further provided that the controller additionally raises the machine frame after completion of the termination process of the milling process in order for the ground working machine to be given increased ground clearance and to be more easily repositioned to a different working site.

A particularly preferred embodiment provides that, for termination of the milling process, the machine operator reverses the direction of travel of the machine frame. The controller registers the selected direction of travel and, as a function thereof, controls the correct, i.e. rearward or trailing hood flap as seen in the direction of travel. The now rearward hood flap as seen in the direction of travel is used as a scraper, the scraping height of which is adjustable by the controller.

The invention also relates to a method for milling soils using a ground working machine.

The method according to the invention also provides, among other things, that the mixed aggregate levelled off by the rearward hood flap as seen in the direction of travel on the one hand, and the mixed aggregate removed and conveyed into the depression by the milling device moved along the trajectory specified by the controller on the other hand, is used to fill up, with mixed aggregate, the depression remaining when raising the milling device.

In the following, one embodiment of the invention is explained in greater detail with reference to the drawings.

Figure 2:
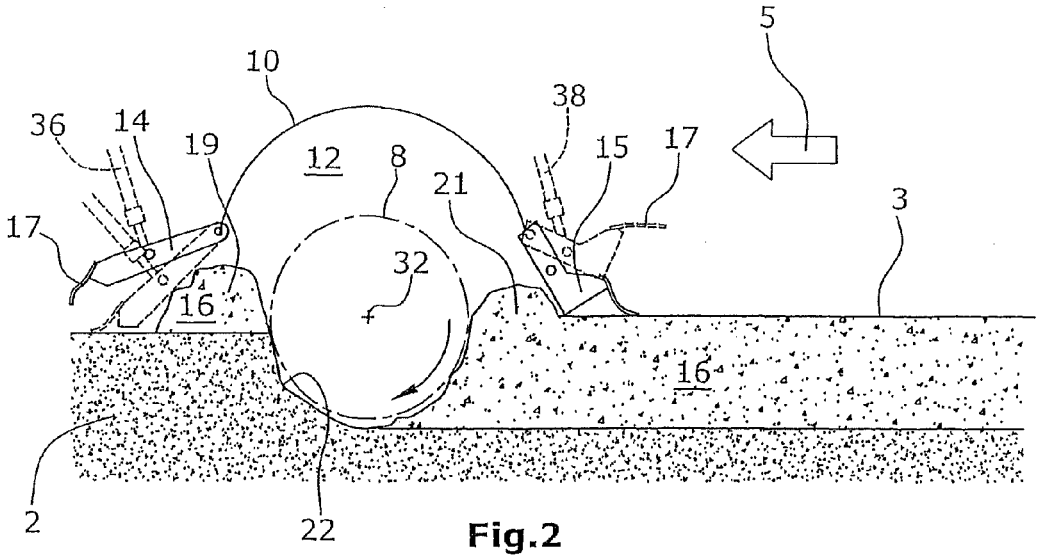
Figure 3:
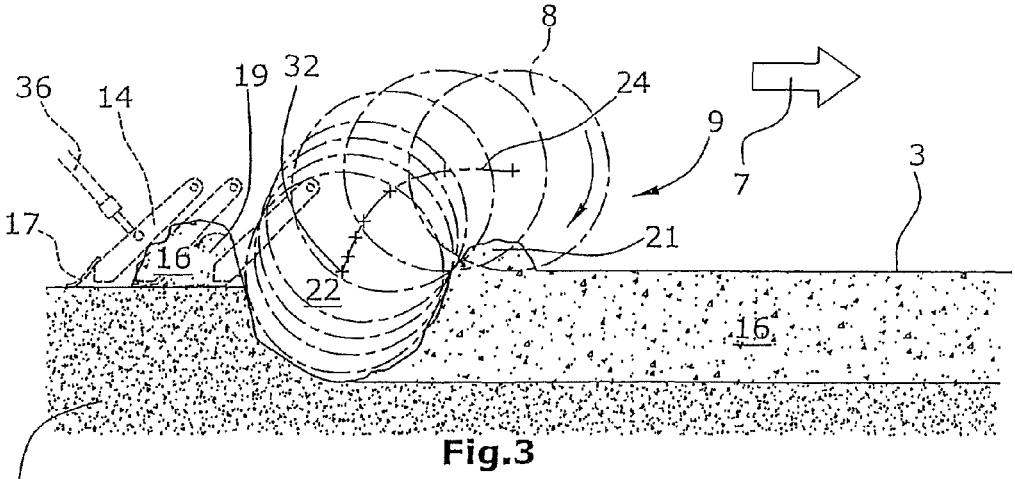
Figure 4:
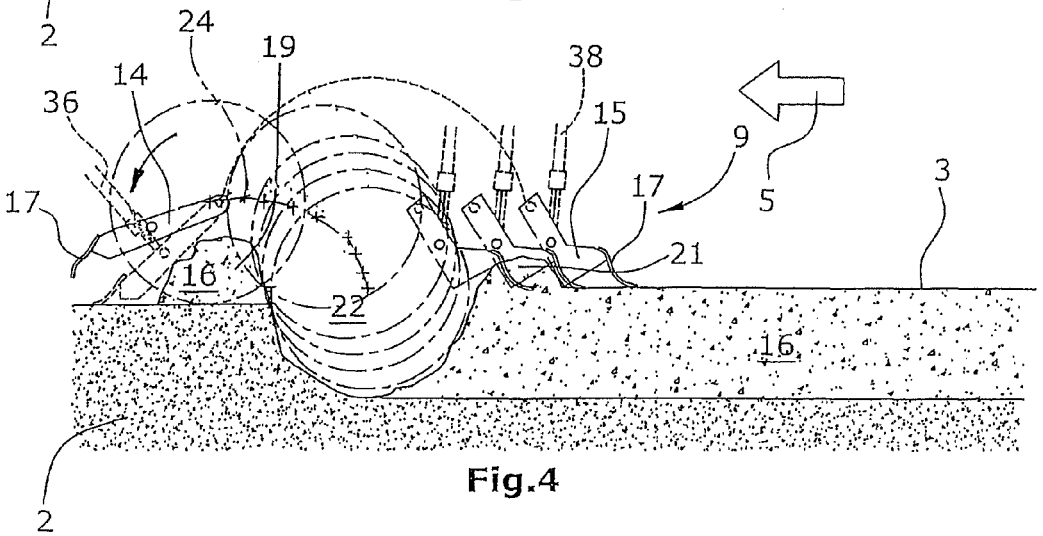

The following is shown:

FIG. 1 is a schematic side view of an embodiment according to the invention of a ground working machine operating against the direction of travel, FIG. 2 shows the accumulations of mixed aggregate and the depression at the milling device when terminating the milling process, FIG. 3 is the visualization of the trajectory specified by the controller based on the path of the axis of the milling rotor in reverse travel, and FIG. 4 is a visualization corresponding to FIG. 3 in forward travel.

FIG. 1 depicts the ground working machine 1 for milling soils and carriageways with a machine frame 6 carried by suspension units 4 and an operator's platform consisting of a driver's cabin 26. The driver's cabin 26 is movable on the machine frame in a sliding fashion transversely to the direction of travel. The seat in the operator's platform can be turned about 180° for reverse travel.

The ground working machine 1 apparent from FIG. 1 is known from WO 96/24725. The technical solutions described within the context of this application are applicable also to stabilizers or recyclers as they are known, for example, from WO 2005/054578 or EP 2218823 A. The suspension units 4 comprise two jointly or optionally separately steerable suspension axles 30 at the front and rear ends of the machine frame 6. Each wheel of the suspension unit 4 is provided with a lifting column 28 so that the height of the machine frame 6 and, where required, its inclination is precisely adjustable to the working or transport height. Below the driver's cabin 26, a hood 10 mounted at the machine frame 6 either permanently or suspended from a chain is located between the suspension axles 30, said hood 10 enclosing the milling device 8, in particular a milling rotor, and forming a mixing chamber 12 for the worked-off mixed aggregate 16 between the milling device 8 and the hood 10.

The milling device 8 can be lowered to a set milling depth by means of a height adjustment device 20, or can be raised again out of the worked ground 2 after termination of the milling process.

The hood 10 may be mounted at the machine frame 6 in a permanent fashion and is provided, at its frontward and rearward ends as seen in the direction of travel 5, with hood flaps 14,15 pivotable by way of adjustment devices 36,38, said hood flaps 14,15 closing, as and when required, the mixing chamber 12 of the hood 10 toward the ground surface 3 of the ground 2.

Alternatively, the hood may be suspended from the machine frame by means of chains, i.e., when in operating mode, the hood 10 glides over the ground suspended from the chains. When the milling rotor is driven to a milling depth of zero, the hood 10 still rests on the ground surface 3. When the milling rotor is raised even higher, it takes the hood 10 with it, thus lifting the hood 10 from the ground.

For the purpose of sealing and closing toward the ground surface 3, the pivotable hood flaps 14,15 may additionally be provided with a flexible strip 17, for example, a rubber lip.

According to the embodiment in FIG. 1, the milling rotor 8 is supported in a pivoting device 11 which is mounted to pivot at the machine frame 6, where the milling rotor axis 32, or the output drive shaft of the milling rotor drive respectively, can be pivoted in a slot 19 in the side walls of the hood 10 in order to enable adjustment of the milling depth.

It is understood that the height adjustment of the milling device 8 may likewise be effected in a different fashion, for instance, as described in WO 2005/054578.

The milling rotor drive is preferred to be a mechanical drive which is, for example, driven by a combustion engine via a belt drive.

FIG. 2 schematically illustrates the situation arising when milling against the direction of travel during forward travel 5. Milling against the direction of travel and mixed aggregate 16 spilling from the mixing chamber 12 cause a material accumulation 19,21 consisting of mixed aggregate 16 to build up both in front of and behind the milling rotor 8. As the mixed aggregate 16 is loosened in comparison with the ground 2, the accumulations of mixed aggregate 19,21 in front of and behind the milling device 8 are slightly greater in volume than the depression 22 in which the milling device 8 is working during the milling process. As can be seen from FIG. 2, the frontward hood flap 14 may be raised and the rearward hood flap 15 as seen in the direction of travel may be lowered during forward travel 5 in order to level off the recycled mixed aggregate 16 at a pre-adjusted height.

If the milling process is terminated in the position shown in FIG. 2, and the milling device 8 is disengaged from the ground 2 by means of raising, the soil structure depicted in FIG. 2 with the two accumulations of mixed aggregate 19,21 is what essentially remains on both sides of the depression 22. As such considerable irregularities occur with each turnaround or repositioning of the ground working machine 1 at the end of a milling cut, subsequent leveling operations are required to a significant extent to level off the ground surface 3 at the ends of a milling cut.

This applies all the more in those cases where, when being transferred to another operating site, the ground working machine needs to be raised higher via the lifting columns, thus causing the accumulations of mixed aggregate 19,21 to remain next to the depression 22.

Theoretically, it would be possible to move the ground working machine 1 back and forth several times with the milling device 8 in raised position and to push the accumulations of mixed aggregate 19,21 into the depression 22 by means of the pivoting hood flaps 14 and 15. This is not possible in practice, however, because the machine operator in the driver's cabin 26 cannot see the depression 22 and can therefore not perform control of the hood flaps 14,15 as well as coordination of the same with forward or reverse travel 5,7.

The ground working machine 1 is provided with a controller 18 which, for termination of the milling process, automatically controls the milling depth of the milling device 8 in conjunction with simultaneous forward and reverse travel 5,7. To this effect, the machine operator merely needs to give a corresponding command to the controller 18 so that the controller 18 is able to activate the height adjustment device 20 for termination of the milling process. Control is effected along a specified trajectory 24 which may be stored in the controller 18 so that the milling device 8 can be raised into the upper position 9 disengaged from the ground shown in FIG. 3 without a depression 22 resulting from raising the milling device 8 remaining in the worked ground surface 3. The trajectory 24 is illustrated in FIG. 3 as connecting line of the positions of the axis of rotation 32 of the milling device 8 designed as a milling rotor.

In addition to the milling depth, the controller 18 may also control the position of the hood flaps 14,15.

FIG. 3 shows a degressively increasing curve of the trajectory 24. FIG. 3 shows the situation in which the ground working machine 1 has driven, in forward travel 5, into the position shown in FIG. 2, with a command having then been given to the controller 18 to terminate the milling process. The milling device 9 then performs the course of movement apparent from FIG. 3, according to the trajectory 24, in reverse travel 7, with the then trailing hood flap 14 being used as the scraping device, the scraping height of which is adjusted by the controller 18 so that the now rearward hood flap 14 as seen in the direction of travel pushes accumulations of mixed aggregate 19 into the depression 22. As already shown in FIG. 2, the frontward hood flap 15 as seen in the direction of travel is raised into the position indicated as a dashed line in order for it not to create a new accumulation during reverse travel 7 but to enable the milling rotor to mill off said accumulation 21 during reverse travel 7, thus transferring it into the depression 22.

The trajectory 24 may also have the form of an asymptote, for example, the form of an arctan function, although the form of the trajectory 24 is not limited thereto.

The controller 18 synchronizes the path of the height adjustment, via the height adjustment device 20, with the path in the direction of travel (forward travel 5 or reverse travel 7).

It is understood that the trajectories 24 for filling up the depression 22 run differently from those depicted in FIG. 3 when milling in the direction of travel or when raising in forward travel 5. If the milling device 8 leaves the depression 22 in forward travel as shown in FIG. 4, the then rearward hood flap 15 as seen in the direction of travel takes over the scraping function specified by the controller 18.

The path required to fill up the depression 22 is approximately 1 to 3 diameters of the milling rotor.

For different ground materials and for raising in forward or reverse travel, different trajectories 24 may be stored in the controller 18.

The flap position of the currently trailing flap 14,15 can be adjusted by the controller 18, via adjustment devices 36,38, to a height which takes into consideration the increase in volume of the mixed aggregate 16 due to loosening of the same during the milling process. These control parameters may also be stored, together with the trajectory 24, in the controller 18 in accordance with specific materials.

The course of action described above enables the depression 22 to be filled with mixed aggregate 16 having the same degree of loosening as that created during the entire milling process of a milling cut. In other words: the milling process can be completed without any depressions 22 and accumulations of mixed aggregate 19,21 remaining, and without any differences remaining in the degree of loosening of the ground surface worked. This is essential for subsequent working of the ground surface 3 by means of compaction machinery, as well as for the subsequent road pavement laying machines which apply a road or carriageway pavement onto the compacted ground surface 3. Because, if the recycled mixed aggregate 16 exhibits any significant differences in density, these are possibly even exacerbated, for example, by the compaction machinery following behind so that a subsequently applied carriageway pavement exhibits irregularities in the corresponding places.

What is claimed is:

1. A ground working machine for milling soils or traffic areas, comprising a chassis and a machine frame, with a milling device rotating about a milling axis transverse to a direction of travel of the machine frame, with a hood enclosing the milling device mounted at or suspended from the machine frame, said hood forming a mixing chamber for the mixed aggregate between the milling device and the hood, with a height adjustment device for adjusting the milling depth of the milling device, where the hood enclosing the milling device is provided, at the frontward and/or rearward end as seen in the direction of travel, with a pivotable hood flap which closes the mixing chamber of the hood toward the ground surface of the ground, characterized in that a controller for terminating the milling process controls the milling depth of the milling device along a specified trajectory in conjunction with simultaneous forward or reverse travel, thus enabling the milling device to be raised into the upper position disengaged from the ground without a depression resulting from raising the milling device remaining in the worked ground surface.

2. The ground working machine in accordance with claim 1, characterized in that the controller controls the milling depth of the milling device along a trajectory specified in accordance with the direction of travel of the machine frame.

3. The ground working machine in accordance with claim 1, characterized in that the controller synchronizes a path of the height adjustment of the milling device with a path in the direction of travel.

4. The ground working machine in accordance with claim 1, characterized in that the controller for terminating the milling process additionally controls the position of at least one hood flap.

5. The ground working machine in accordance with claim 4, characterized in that the flap position of a trailing hood flap is controllable to a height which takes into consideration an increase in volume of the mixed aggregate due to loosening of the mixed aggregate during the milling process.

6. The ground working machine in accordance with claim 1, characterized in that the specified trajectory of the controller for terminating the milling process follows a degressively increasing curve.

7. The ground working machine in accordance with claim 1, characterized in that the specified trajectory of the controller for terminating the milling process essentially exhibits the curve of an asymptotic function, or of an arctan function.

8. The ground working machine in accordance with claim 1, characterized in that, for terminating the milling process, the direction of travel of the machine frame is reversible and the controller uses the now rearward hood flap as seen in the direction of travel as a scraper and controls the scraping height of the same.

9. The ground working machine in accordance with claim 1, characterized in that the machine frame is height-adjustable.

10. A ground working machine, comprising:

a machine frame having a direction of travel;

a milling rotor supported from the machine frame and adjustable in height relative to the machine frame to adjust a milling depth of the milling rotor;

a hood enclosing the milling rotor and configured to engage a ground surface during milling operation, the hood forming a mixing chamber for mixed aggregate between the milling rotor and the hood, the hood having at least one hood flap adjustable in height; and a controller configured to automatically control a trajectory of the milling rotor and a position of the hood flap upon termination of the milling process such that a depression formed by the milling rotor in the ground during the milling process is automatically filled with mixed aggregate from forward and rearward of the depression as the milling rotor is raised from the depression.

11. The machine of claim 10, wherein:

The controller is configured to synchronize a path of height adjustment of the milling rotor with a path of travel of the machine as the milling rotor is raised from the depression upon termination of the milling process.

12. The machine of claim 10, wherein:

the controller is configured to control the position of the hood flap to accommodate an increase in volume of the mixed aggregate due to loosening of the mixed aggregate during the milling process.

13. The machine of claim 10, wherein:

the controller is configured such that the trajectory of the milling rotor follows a degressively increasing curve.

14. The machine of claim 10, wherein:

the controller is configured such that the trajectory of the milling rotor follows an asymmetric function.

15. The machine of claim 10, wherein:

the controller is configured such that the trajectory of the milling rotor follows an arctan function.

16. The machine of claim 10, wherein:

the machine frame is height adjustable.

17. The machine of claim 10, wherein:

the milling rotor is an upcut rotor cutting against the direction of travel; and the controller is configured to cause the machine to move in a rearward direction as the milling rotor is raised from the depression.

18. The machine of claim 10, wherein:

the milling rotor is a downcut rotor; and the controller is configured to cause the machine to move in a forward direction as the milling rotor is raised from the depression.

* * * * *

UNITED STATES PATENT AND TRADEMARK OFFICE

CERTIFICATE OF CORRECTION

PATENT NO. : 8,485,755 B2
APPLICATION NO. : 13/298377
DATED : July 16, 2013
INVENTOR(S) : Menzenbach et al.

It is certified that error appears in the above-identified patent and that said Letters Patent is hereby corrected as shown below:

Title Page, at (75), replace "Barlmani" with --Barimani--.

Signed and Sealed this
Eighteenth Day of February, 2014

Michelle K. Lee

Michelle K. Lee
*Deputy Director of the United States Patent and Trademark Office*